United States Patent [19]

McAnulty, III

[11] Patent Number: 4,858,454

[45] Date of Patent: Aug. 22, 1989

[54] DOOR LOCK PROTECTING DEVICE

[76] Inventor: Frederick J. McAnulty, III, 114 Furbush Rd., West Roxbury, Mass. 02132

[21] Appl. No.: 147,111

[22] Filed: Jan. 21, 1988

Related U.S. Application Data

[63] Continuation-in-part of Ser. No. 851,802, Apr. 14, 1986, abandoned, which is a continuation of Ser. No. 576,210, Feb. 2, 1984, abandoned.

[51] Int. Cl.[4] ..... E05B 17/18

[52] U.S. Cl. ..... 70/455; 16/320; 206/818; 220/230

[58] Field of Search ..... 70/455, 423–428, 70/276, 452, 54, 55; 292/DIG. 2, 251.5; 16/320, DIG. 14; 206/818; 215/237; 220/230

[56] References Cited

U.S. PATENT DOCUMENTS

| | | | |
|---|---|---|---|
| 1,917,973 | 7/1933 | Hughes | 70/427 |
| 2,096,568 | 10/1937 | Snively | 70/455 |
| 2,471,635 | 5/1949 | Mark et al. | 206/818 X |
| 3,152,716 | 10/1964 | Feldhahn | 16/320 X |
| 3,421,350 | 1/1969 | Shanok et al. | 70/455 |
| 3,434,318 | 3/1969 | Thiry | 70/455 |
| 3,782,149 | 1/1974 | Carter | 70/455 |
| 4,090,379 | 5/1978 | Lehuer | 292/251.5 X |
| 4,154,072 | 5/1979 | Flaschar | 70/455 |
| 4,282,732 | 8/1981 | Bennett | 70/455 |
| 4,428,211 | 1/1984 | Hermann | 70/455 X |
| 4,709,567 | 12/1987 | Appelbaum | 70/455 |

FOREIGN PATENT DOCUMENTS

| | | | |
|---|---|---|---|
| 1902467 | 10/1970 | Fed. Rep. of Germany | 70/455 |
| 325985 | 11/1975 | Fed. Rep. of Germany | 70/455 |
| 1046488 | 7/1953 | France | 206/818 |
| 226025 | 4/1969 | Sweden | 70/455 |
| 383984 | 12/1932 | United Kingdom | 70/455 |

*Primary Examiner*—Lloyd A. Gall

*Attorney, Agent, or Firm*—Richard P. Crowley

[57] ABSTRACT

A vehicle lock protecting device particularly for protecting automobile door lock, which device comprises a base secured about the lock, the base having a hinged cover and characterized by an opening which fits about the lock. A resilient material, such as a compressible fiber or a foam material within the cover, is placed in a compressive sealing relationship with the face of the lock and across the lock key entrance when the cover is in a closed position. A latch mechanism or permanent magnets in the cover permit opening of the cover for use of the lock and provide the fiber or foam material to be held in a sealing compressible position against the lock surface when the lock is not in use and the cover is in a closed position.

10 Claims, 2 Drawing Sheets

DOOR LOCK PROTECTING DEVICE

REFERENCE TO PRIOR APPLICATIONS

This application is a continuation-in-part of U.S. Ser. No. 851,802, filed Apr. 14, 1986, now abandonded, and which application was a continuation application of U.S. Ser. No. 476,210, filed Feb. 2, 1984, now abandoned.

BACKGROUND OF THE INVENTION

Locks, particularly automobile and truck locks having an entrance for the insert of a key, are subject to malfunctions due to exposure to foreign matter or moisture. Many times automobile and/or truck owners find that in cold weather the automotive or truck door lock mechanism due to moisture exposure becomes frozen and the lock, therefore, becomes difficult to open or cannot be opened. In ordinary weather locks also are subject to malfunctions due to sand, dirt or foreign matter penetrating the lock. Thus, it is desirable to provide a mechanism to protect locks from moisture and foreign matter particularly as to automobile and truck locks that are typically exposed to foreign matter or adverse weather conditions.

SUMMARY OF THE INVENTION

The invention relates to a lock protecting device and in particular concerns a protecting device for vehicle locks useful for preventing locks from becoming frozen during winter conditions and preventing foreign matter from entering the lock.

A lock protecting device has been discovered which is simple in design, yet effective in protecting locks, particularly vehicle locks from moisture and foreign matter. The lock protecting device is easily installed and placed in a closed position protecting the lock and the key entrance of the lock from moisture and foreigh matter and yet the lock protecting device may be placed easily in an open position for use in opening the lock.

The lock protecting device comprises a base characterized by an opening with a peripheral surface therein in which said opening sealingly fits about the exterior peripheral surface of the lock to be protected and means to secure the base to said exterior surface; a cover having an interior surface with means to secure the cover to the base so to permit the cover to move between a closed position where the lock is protected and an open position where the lock may be used; and a resilient material adapted to be placed in a compressive sealing relationship about the peripheral surface of the opening in the base to protect the lock when the cover is in a closed position or against the exterior surface of the lock and across the key entrance or both.

The base and cover of the lock protecting device can be made of a variety of materials including metal or plastic. The type of material is dependent on the surface surrounding the lock and the likelihood of the device being subject to a dislodging impact. To prevent water seepage between the base and the lock, the base is positioned in a sealing relationship about the lock surface. The base can be secured by magnets, screws, welding, adhesives, Velcro ® or any combination of the same to the surface to or in which the lock is secured. The base further includes an opening with a peripheral surface generally designed to fit snugly about the particular circumference of the lock to be protected thereby allowing access to the lock and key through the base when the cover is in an open position.

The cover having an interior surface is hingedly attached to the base permitting the cover to move between a closed position where the lock is protected by the fiber or foam material and an open position where the lock may be used. The cover includes a resilient, moisture-resistant material, preferably of fiber or a closed cell, flexible foam, which when compressed between the cover and base in the closed position, develops a sealing relationship with the peripheral surface of the opening in the base or directly compressively against the exterior surface of the lock and key entrance thereby preventing the entry of moisture and foreign matter into the lock mechanism. The opening and peripheral surface in the base may fit snugly around the lock or extend to the perimeter of the base.

The resilient material may be attached to and within the cover by various means, such as by the use of chemical adhesives, and may be further supported by the employment of one or more permanent magnets. Typically, bar magnets are preferred although other configurations are suitable. The magnets are so disposed that when in the closed position they are magnetically attracted to the underlying metal of the base compressing the resilient material against cover and base and forming a sealing relationship against the peripheral surface of the opening. If a plastic base is used then the attraction is to the underlying body metal of the vehicle. In the closed position, the resilient material is compressed against the inner surface of the cover and the surface of the key opening in the base extending into a sealing relationship with the surface of the lock to be protected.

Other means for securing the cover and base in the closed position include clasp and latching mechanisms. These can be fixed on the mating surface of either cover or base and either within or on the surface of the device. It is desirable that the latching mechanism and/or magnets resist the repulsive forces generated by the resilient material when compressed between cover and base. It is further desirable that the device be readily opened to allow unobstructed access to the lock and yet maintain a secure seal around the lock against moisture and foreign contaminants when in the closed position.

One means of securing the base to the surface of the lock to be protected includes the use of a pair of spaced apart ear lugs connected to the base and containing a means for fastening, such as bolts and nuts. The bolts, nuts or screws hold the base in a sealing relationship against the surface of the lock to be protected forming a barrier to water runoff.

The cover may be secured to the base by permanent magnets so disposed in the cover positioned usually about or on each side of the lock key entrance to provide magnetic attraction with the base or lock surface when in the closed position and maintain a sealing relationship between the resilient material and the surface of the lock to be protected. An arrangement recognized by the inventor is to penetrate the resilient material with bar magnets to a depth sufficient to maximize the magnetic attractive forces with the base or lock surface and yet far enough from the base to maintain the lock free from contaminants. The magnet typically should be positioned so that the magnet surface is slightly below the surface of the resilient material in the cover. The magnetic force will then function to hold the cover in the closed position by magnetic force while permitting the cover to be easily placed in the open position for use and also hold the resilient material in a compressible state closely adjacent the key surface and over the key entrance. The resilient material compressed between base and cover when in the closed position is of a uniform layer and extends radially outward to the perimeter of the base.

The lock protecting device finds application in all situations where a lock is subject to foreign contaminants particularly in circumstances involving vehicle door and trunk locks. The device is easily attached and when in the closed position protects the lock from moisture and road contaminants. When in the closed position, the permanent bar magnets are disposed within the lock protecting device, for example, parallel and on either side of the opening in the base. The magnetic attraction to the base compresses the resilient material forming a sealing relationship with the surface of the lock.

The lock protecting device may be used in protecting vehicular door locks. The base, hingedly connected to the cover, should be of a thin material, plastic or sheet metal, with the opening fitting snugly around the perimeter of the door lock. The surface of the door lock should preferentially be flush with or extending inwardly from the interior surface of the base. In automobiles and trucks, the opening would be generally circular in nature. The base and cover typically are made to a shallow depth, and the cover is connected to the base by hinges positioned so to permit access to the lock when in the open position and provide protection for the lock when closed.

In operation, the lock protecting device is secured to and about the lock surface with the lock within the opening in the base. The cover can then be placed in a closed position seating the cover on the base thereby protecting the key opening of the lock from moisture and foreign matter, or placed in an open position permitting access to the lock. A preferred means of securing the base and cover include the use of a clasp or latch mechanism alone or in conjunction with permanent magnets. The magnets are disposed on either side of the circular opening of the base when the cover is in the closed position. The cover compresses a uniform layer of soft, flexible foam material typically a closed cell material such as a urethane foam and more particularly a foam cell material moisture resistant or treated to be moisture resistant. If desired, the resistant material may comprise a moisture-resistant, insulating-type, soft, fibrous material, such as a felt material, which is impervious to moisture and which will provide an effective seal with the other surface of the door lock. The resilient material is preferably secured to the cover by a chemical adhesive and may be further supported by bar magnets which seat on the cover and traverse the material. It is desirable that the resilient material be of such a depth to fit snugly and sealingly against the outer exterior surface of a vehicular lock, when the cover is closed. In one embodiment, the resilient material should extend slightly above the top of the cover, e.g. one-eighth to one-quarter inch. The cover however is easily opened by the user and after opening, is easily closed to provide protection for the lock.

The invention will be described for the purpose of illustration only in connection with certain embodiments; however, it is recognized that various changes, modifications and improvements may be made in the embodiments so illustrated all falling within the spirit and scope of the invention.

DESCRIPTION OF THE EMBODIMENTS

Figure 1:
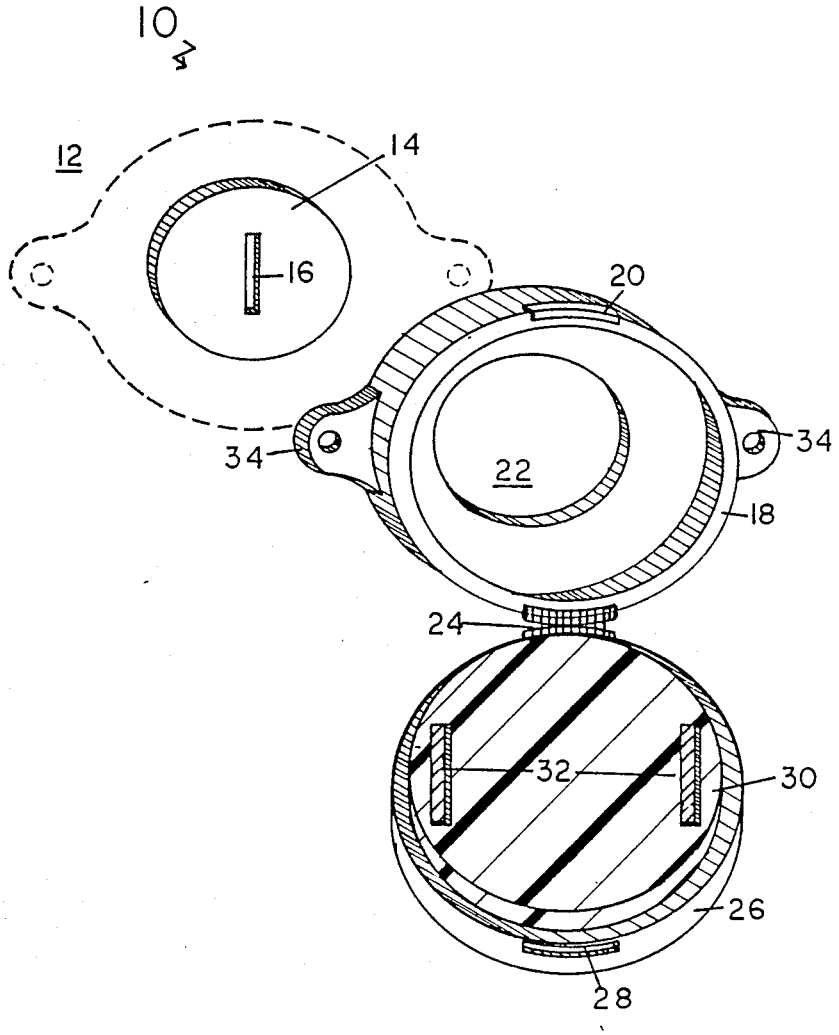
FIG. 1 is an illustrated perspective, partially exploded view of the door lock protecting device in the open position.

The drawings show a door lock protecting device 10 of the invention adapted to be secured to the surface of a vehicle 12 having a lock 14 with a key entrance 16. The door lock protecting device includes a generally circular, shallow depth metal base 18 having a latch 20 and the base characterized by a circular opening 22 adapted to fit about the exterior surface of the lock 14. The depth of the base 18 is about the same or slightly greater than the depth of the door lock 14 so that the surface of the lock 14 will be flush with or below the interior surface of the base. The device 10 includes a shallow depth cover 26 connected by hinges 24 to the base 18, which cover includes a latch opening 28 to be matingly engaged to latch 20 so as to place the lock protecting device in a secured or closed position. The base also contains two ear lugs 34 with holes therein with the bolts or screws (not shown) securing the base directly to the automobile 12 and about the door lock 14. The interior of the cover 26 is filled with a soft, resilient, closed cell urethane foam material 30, which extends slightly above the top of the cover 26. Inset in the foam material 30 and disposed to be positioned on either side of the outer peripheral of lock 14 and the base opening 22 is a pair of permanent magnets 32. The surface of the magnets is slightly below the surface of the foam material 30.

Figure 2:
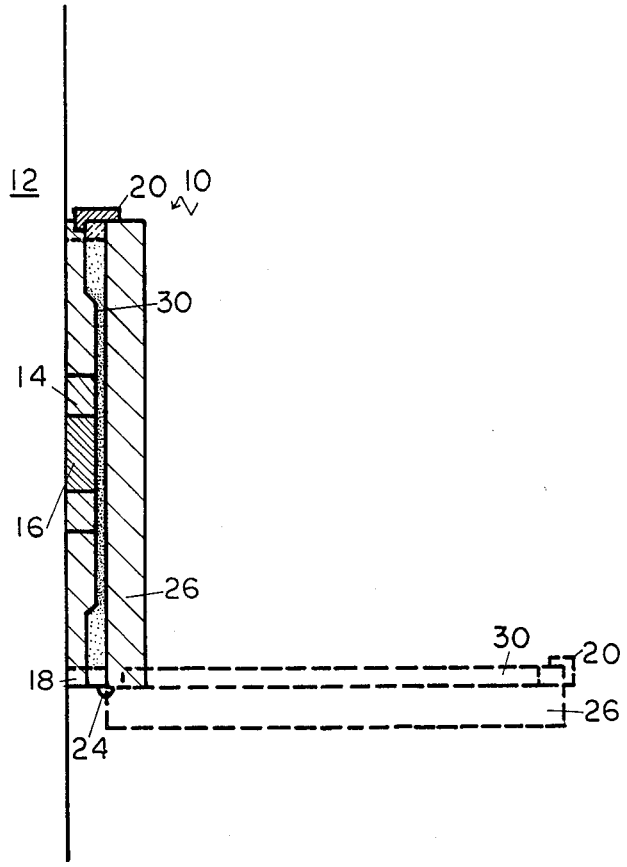
FIG. 2 is an illustrated sectional view of the door lock protecting device of FIG. 1 in the closed position along the lines 2—2 of FIG. 3, the open position illustrated in dotted lines.
Figure 3:
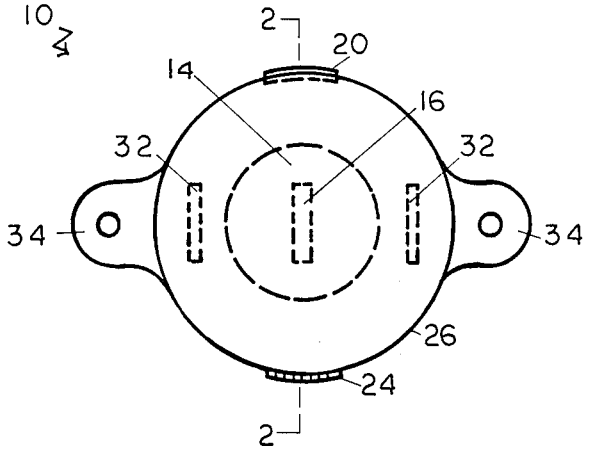
FIG. 3 is a top plan view of the door lock protecting device of FIG. 1 in the closed position with certain components illustrated by dotted lines.

FIG. 2 sectionally illustrates the door lock protecting device in the closed and open (dotted line) position. In the closed position, the foam material 30 is illustrated as compressed against the lock surface and sealingly across the slotted key entrance 16. The base 18 has a depth of about the height of the lock 14, while the foam material 30 extends slightly beyond the top of the cover 26. The foam material 30 may be below the top of the cover only provided that in the closed position the material 30 is against the lock surface. The foam material 32 also is sealingly about the periphery of the lock 14.

In operation when the cover 26 is in a closed position, that is, when the latch opening 28 is latched with latch 20, the permanent magnets provide by magnetic attraction to the base for the close, snug adherence of the urethane foam material 30 against the external surface of the lock 14 and across the slotted key opening 16 to protect the lock. When in use, the cover 26 is easily unlatched and swung down in the open position so that the user may insert the key in the lock 14, then after opening the lock the cover 26 is swung up into a closed position. If desired, the permanent magnets 32 may be substantially flush with the surface of the foam material 30, but in the preferred operation, the permanent magnets 32 are slightly depressed to provide for the slight compression of the urethane foam material 30 against the surface of the door lock 14. The door lock protecting device of the invention is a simple, yet effective device to protect the door lock, particularly an automotive door lock, against moisture and foreign matter.

What is claimed is:

1. A lock protecting system to prevent the exposure of a lock to moisture and foreign material, which lock protecting system comprises in combination:

(a) a lock secured to a surface, the lock having a lock entrance opening subject to exposure to moisture and foreign matter; and (b) a lock protecting apparatus which comprises:

(i) a base characterized by an opening therein to fit about said lock;

(ii) means to secure the base to said surface so that the lock opening is located within the said opening of the base;

(iii) a cover;

(iv) means to secure the cover to the base so to permit the cover to move between a closed position where the lock and the lock opening are protected, and an open position where the lock may be used;

(v) a resilient, compressible, moisture-resistant material, which compressible material is placed in a compressive sealing relationship against the exterior surface of the said lock and over the said lock opening when the cover is in a closed position to protect the lock from moisture and foreign matter; and (vi) a permanent magnet means positioned within the resilient material to maintain by magnetic force the resilient material in said compressive sealing relationship, when the cover is in a closed position.

2. The system of claim 1 wherein the resilient material comprises a resilient, closed cell, flexible urethane foam material.

3. The system of claim 1 wherein the means to secure the cover to the base comprises hinged means to connect the cover and the base together and latch means to mate the cover and base together in a closed position.

4. The system of claim 1 wherein the means to secure the base to said surface comprises spaced apart lugs on the base, the lugs characterized by holes for the insertion of fasteners to secure the base about the said surface of the lock to be protected.

5. The system of claim 1 wherein said lock comprises a vehicular lock with a key entrance opening.

6. The system of claim 1 which includes a plurality of permanent magnets in the resilient material.

7. The system of claim 1 wherein the depth of the base is the same as or greater than the depth of said lock.

8. The system of claim 1 wherein the resilient material extends slightly by $\frac{1}{8}$ to $\frac{1}{4}$ of an inch above the top of the cover.

9. A lock protecting system to prevent the exposure of a lock to moisture and foreign material, which lock protecting system comprises in combination:

(a) a lock secured to a surface, the lock having a lock entrance opening subject to exposure to moisture and foreign matter; and (b) a lock protecting apparatus which comprises:

(i) a base characterized by an opening therein to fit about said lock;

(ii) means to secure the base to said surface so that the lock opening is located within said opening of the base;

(iii) a cover;

(iv) means to secure the cover to the base so to permit the cover to move between a closed position where the lock and the lock opening are protected, and an open position where the lock may be used;

(v) a resilient, compressible, moisture-resistant, flexible, closed cell urethane foam material, which compressible material is placed in a compressive sealing relationship against the exterior surface of the said lock and over the said lock opening when the cover is in a closed position to protect the lock from moisture and foreign matter; and (vi) a permanent magnet means positioned within the foam material to maintain by magnetic force the foam material in said compressive sealing relationship when the cover is in a closed position.

10. The system of claim 1 wherein the resilient material comprises a fibrous material.

* * * * *